United States Patent [19]

Kremer, Jr. et al.

[11] 4,077,184

[45] Mar. 7, 1978

[54] PACKAGE-MAKING APPARATUS

[75] Inventors: Fontaine Theodore Kremer, Jr.; Harold Eugene Ramsey, both of Wilmington, Del.

[73] Assignee: E. I. Du Pont de Nemours and Company, Wilmington, Del.

[21] Appl. No.: 686,506

[22] Filed: May 14, 1976

[51] Int. Cl.[2] ..... B65B 31/02

[52] U.S. Cl. ..... 53/112 A

[58] Field of Search ..... 53/22 A, 112 A

[56] References Cited

U.S. PATENT DOCUMENTS

| | | | |
|---|---|---|---|
| 3,071,905 | 1/1963 | Morse | 53/22 A |
| 3,676,979 | 7/1972 | Schuette | 53/112 A |
| 3,910,008 | 10/1975 | Johnson | 53/112 A |

*Primary Examiner*—Travis S. McGehee

[57] ABSTRACT

A method of and apparatus for vacuum skin packaging is provided. A heated, upper thermoplastic film, as held on the lower surface of a vacuum chamber is moved downwardly so as to drape the film around a product positioned on a lower thermoplastic film. This movement forms a hermetic seal between the vacuum chamber, the two films, a conveyor belt upon which the lower film rests, and a fixed vacuum plate over which the belt is moved. Enclosed within this seal are opposed sets of apertures in the belt, which apertures are aligned with the opposed openings in the plate. The space above the upper film and also around the product is evacuated, the latter occurring through the aligned apertures in the belt and the openings in the plate. The upper film is then pushed by pressure differential into skin-tight conformity with the product and into heat-sealing contact with the lower film to form a vacuum skin-package.

2 Claims, 16 Drawing Figures

FIG. 7
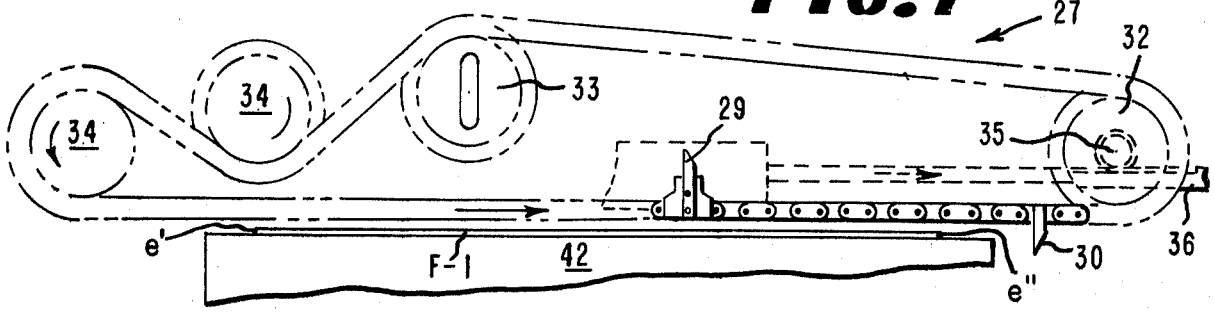
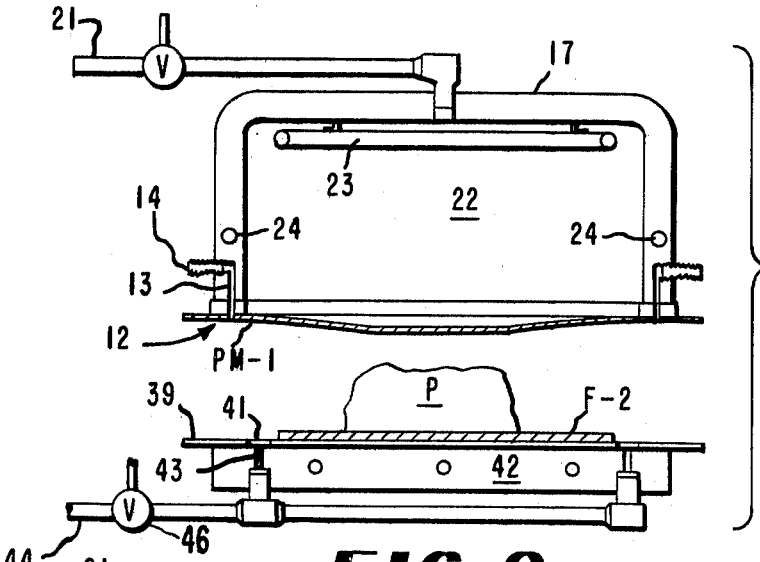
FIG. 8
FIG. 9
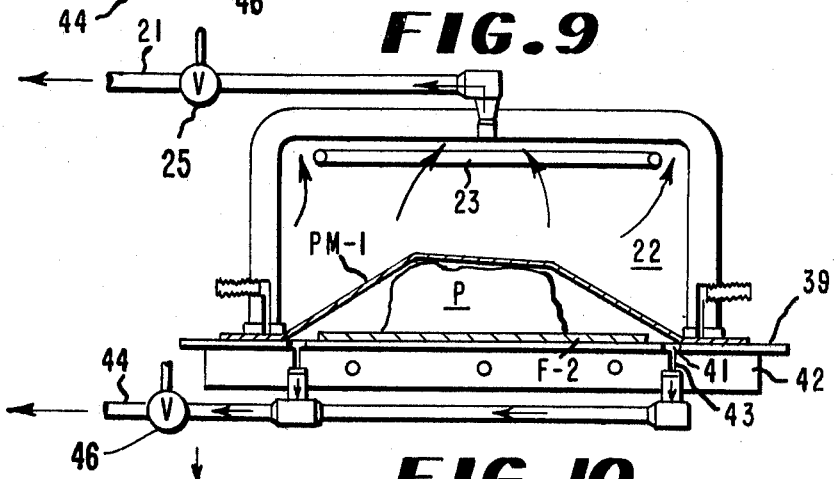
FIG. 10
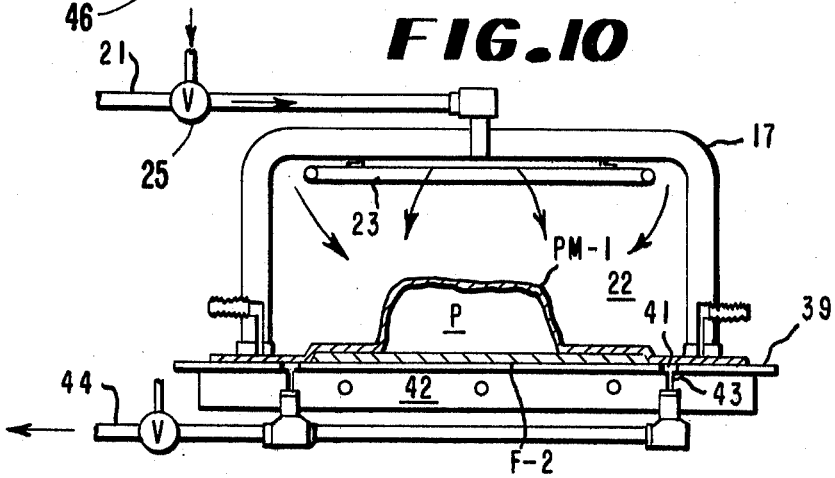

PACKAGE-MAKING APPARATUS

BACKGROUND OF THE INVENTION (1) Field of the Invention

The field of art to which this invention pertains is package-making and, more particularly, it is directed to vacuum skin-packaging.

More specifically, this invention relates to a method of and apparatus for packaging a product, such as a piece of meat, in thermoplastic film. In such method, an upper thermoplastic film is moved downwardly by means of a vacuum chamber over the product and into contact with a lower thermoplastic film on a conveyor belt. The belt which has openings along its edges, moves over a fixed vacuum plate having apertures at its edges and the space around the product is evacuated through these openings and apertures prior to pushing the upper film into skin-like engagement with the product and into heat-sealing contact with the lower film thereby to form a vacuum skin-package.

(2) Description of the Prior Art

Packaging methods and apparatus of this general type are old. It is known, for example, to package an article by pushing an upper film into engagement with the article and a lower film by exerting air pressure on the upper film, after evacuating the space around the product, and various packaging techniques have been utilized to do this.

U.S. Pat. No. 2,690,593 to Abercrombie, which is exemplary of the prior art, for example, discloses moving a heater housing and platen towards a base to envelop an article positioned thereon in a plastic sheet, followed by subjecting the surface of the plastic sheet to reduced pressure to shrink it about the article.

U.S. Pat. No. 2,799,589 to Grinstead et al., another example of this type art, discloses placing a product within packaging material, the edges of which are clamped to produce a fluid tight joint, after which a greater pressure is applied to the outer surface of the material than that existing on the inner surface of the material to make a vacuum skin-package.

Further, U.S. Pat. No. 1,856,694 to Correvont shows a device for laminating a sheet of pyroxylin onto a shaped article, which device has means for gripping and heating the sheet and for forcing the shaped article against the sheet to produce a partial wrapping of the sheet around the shaped article, and means for producing lesser pressure on the article side of the sheet and greater pressure on the opposite side thereof to complete the wrapping of the heat-plasticized sheet around the upper surfaces of the article.

Australian Pat. No. 245,774 describes a noncontinuous vacuum skin-packaging process wherein an article to be packaged is placed on a lower packaging member and inserted within a lower portion of a two-part vacuum chamber. An upper web piece is positioned across the lower part of the vacuum chamber and then the upper part of the chamber is brought into engagement with the lower portion to clamp the piece of upper web between the upper and lower vacuum chambers, and finally the upper web is forced down and around the article and the surrounding portion of the lower packaging member to form a vacuum skin-package.

In further teachings of related packaging techniques in this area, U.S. Pat. No. 3,491,504 to Young et al. shows a packaging method in which a heated upper film is draped over the product while preventing premature sealing of it to a lower packaging member while air is removed between the film and the packaging member, after which the film is pushed against the product and the packaging member to form a heat-sealed, skin-packaged product.

And, lastly, U.S. Pat. No. 3,910,008 to Johnson shows a vacuum packaging system whereby upper and lower films are vacuum sealed about an article at a sealing station, after the space around such article is evacuated.

In the Johnson patent, the article being packaged is placed on a lower embossed film having upwardly extending projections and vacuum is drawn about the edges of this lower film and an upper film positioned above the article and pulled tightly thereabout by such vacuum. The projections allow substantially complete evacuation of air from the enclosed article before the films become completely sealed together thereby to form an airtight package, using this system.

In an important aspect of such system, the lower film with the article thereon, is conveyed to the sealing station by means engagable with the lower film at a point downstream from the sealing station. Such conveying system includes first and second support sections, a drive roll and a pair of friction wheels. The wheels frictionally engage the flattened side portions of the completed package in the nip between the wheels and the drive roller. Since the lower film is continuous, fresh film is drawn from a storage roll or from an embossing assembly through the apparatus in an amount about the distance each successive package is moved. The amount of rotation is predetermined so that the appropriate amount of film will be drawn into the sealing section.

The lower embossed film with its projections directed upwardly is pulled through the first and second support sections to the sealing section. At this location the housing descends over the product and the upper film, which is in a softened state and is secured to the periphery of this housing by vacuum, stretches over the product while the housing continues its downward movement. Simultaneously air is evacuated from the edges of the embossed lower film. As the upper film continues to be lowered, air is removed from the area about the product and such air evacuation continues even after the upper film has made initial contact with the top surfaces of the projections of the lower film. After substantially all the air is removed, the somewhat resilient projections become collapsed due to the pressure differential between the atmosphere and the reduced pressure between the films. At this point the upper film commences to bond to the lower film at the annular area of their overlap about the product periphery and this continues until sealing is completed and the vacuum package is formed.

A problem with the above teachings, and with the other known art, is their failure to give to the vacuum skin-packaging art, a relatively simple means and method of making a package, such as is found in the method and apparatus of this invention, in which apertures in a conveyor belt moving over a fixed plate are aligned with openings in the plate to permit evacuation of the space around a product being packaged, after a movable one-part vacuum chamber moves an upper film over the product and into contact with a flat lower film, which films are then pushed and sealed together to form a vacuum skin-package.

SUMMARY OF THE INVENTION

Briefly summarized, this invention is a method of making a vacuum skin-package including the steps of:

positioning a lower film on a conveyor belt, such belt having means defining opposed sets of apertures spaced from each other along the edges of the belt and the lower film being positioned between the opposed sets of apertures in the belt;

placing a product to be packaged on the lower film between opposed sets of apertures in the belt;

moving the belt having the lower film and the product thereon to a package-forming station above a fixed vacuum plate having means defining opposed openings along the edges thereof, such openings being aligned with opposed sets of apertures in the conveyor belt at the package-forming station, such openings in the vacuum plate being connected to a vacuum source; engaging an upper film with a vacuum chamber at the package-forming station; heating the upper film;

moving the vacuum chamber and the heated upper film downwardly so as to drape the upper film around the product and to form an hermetic seal between the vacuum chamber, the conveyor belt, the lower and upper films and the vacuum plate and to enclose therewithin the opposed sets of apertures in the conveyor belt that are aligned with the opposed openings in the vacuum plate;

evacuating the space above the upper film and also around the product, the latter occurring through such aligned apertures in the conveyor belt and openings in the vacuum plate while maintaining the hermetic seal between the vacuum chamber, the upper and lower films, the conveyor belt and the vaccum plate; and, pushing the upper film by pressure differential into skin-tight conformity with the product and into heat-sealing contact with the lower film to form a vacuum skin-package.

In an important aspect of an embodiment of this invention the upper film first is engaged with a first holding means and moved to a position adjacent the vacuum chamber whereat the upper film is transferred from the holding means into engagement with the vacuum chamber at the package-forming station.

In another important aspect the conveyor belt with the lower film and product thereon is moved in a first direction to the package-forming station and the upper film is moved to the package-forming station in a second direction which is transverse to the first direction. Preferably, vacuum means are used to hold the film against the lower peripheral surface of the vacuum chamber. Lastly, as so held at such package-forming station, the upper film is in position to be moved downwardly in a third direction perpendicular to the plane of the first and second direction movements to start the package-forming operation.

This invention gives to the art a highly practical method of and apparatus for making a vacuum skin-package, in a continuous manner, with a minimum of motions and parts, heretofore not available to it.

BRIEF DESCRIPTION OF THE DRAWINGS

FIGS. 6 and 7 are schematic showings of an upper web severing means for partially, then fully, severing the film to form a package member at such package-forming station.

FIG. 8 shows a cross-sectional view of parts of the apparatus of FIG. 1 in a package-forming starting position at the package-forming station.

FIG. 9 shows the apparatus parts of FIG. 8 in a packaging-forming first position at the package-forming station.

FIG. 10 shows the apparatus parts of FIGS. 8 and 9 in a package-forming second position at the package-forming station, with only lower film severing required at a later station to complete the package-forming operation.

DESCRIPTION OF A PREFERRED EMBODIMENT

This invention is a method of and apparatus for making a vacuum skin-package.

Briefly described, such apparatus generally includes:

Means for moving an upper film from a supply source along a path to a package-forming station;

means for moving a lower film with a product to be packaged positioned thereon along another path into a package-forming starting position at the package-forming station;

means for severing the upper film to form an upper package member, which member is, without further movement, positioned in its package-forming starting position at the package-forming station; and means for forming or making a vacuum skin-package at such package-forming station.

In essence, it is seen that such apparatus generally performs two functions: (1) it places in prepackage-positioning steps the upper and lower films, and the product being packaged, in their operative positions at the package-forming station and, (2) then forms the vacuum skin-package at that station.

Figure 1:
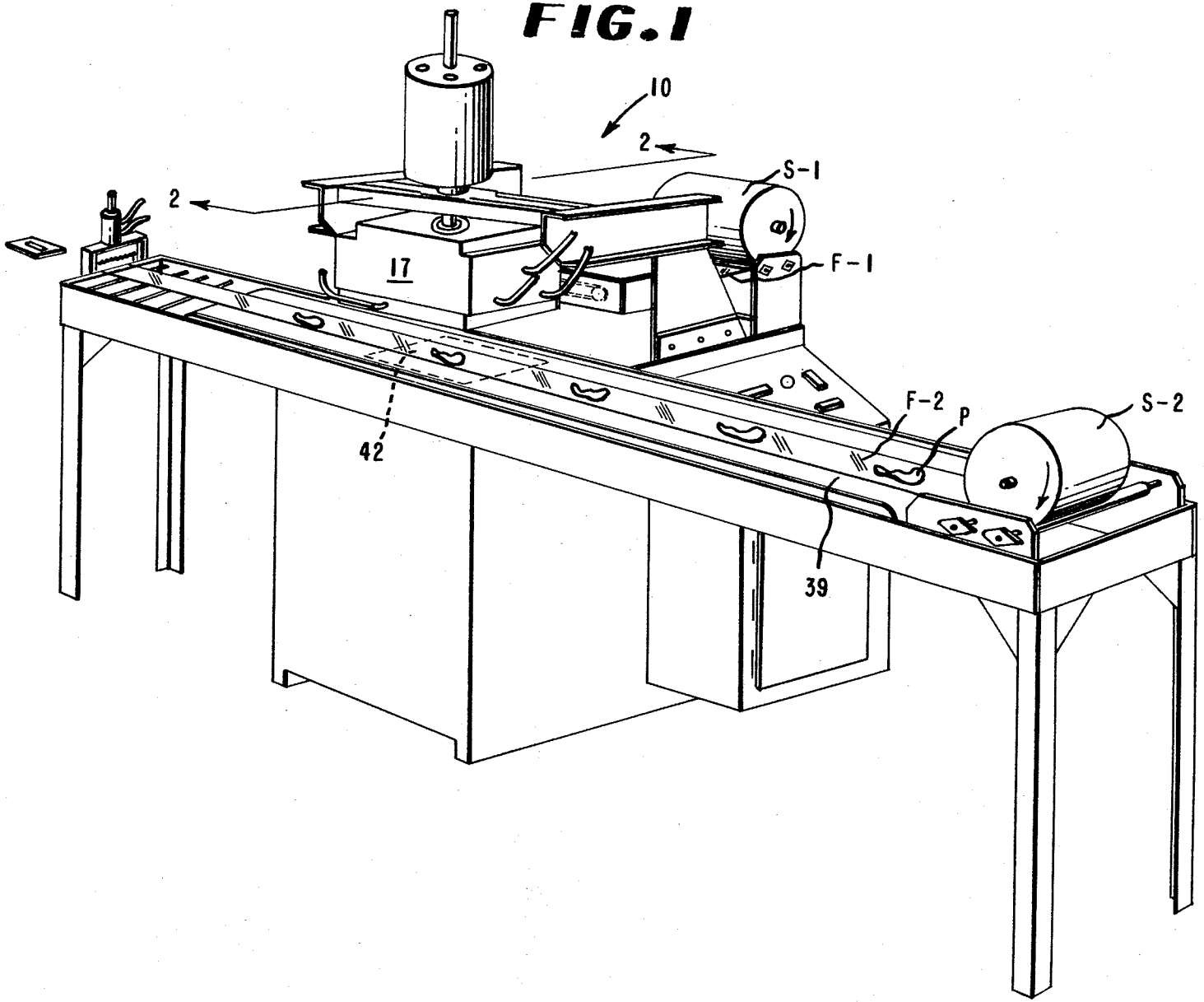
FIG. 1 is a perspective view of an apparatus of this invention, which apparatus is suitable for carrying out a method of vacuum skin-packaging, also of this invention.
Figure 2:
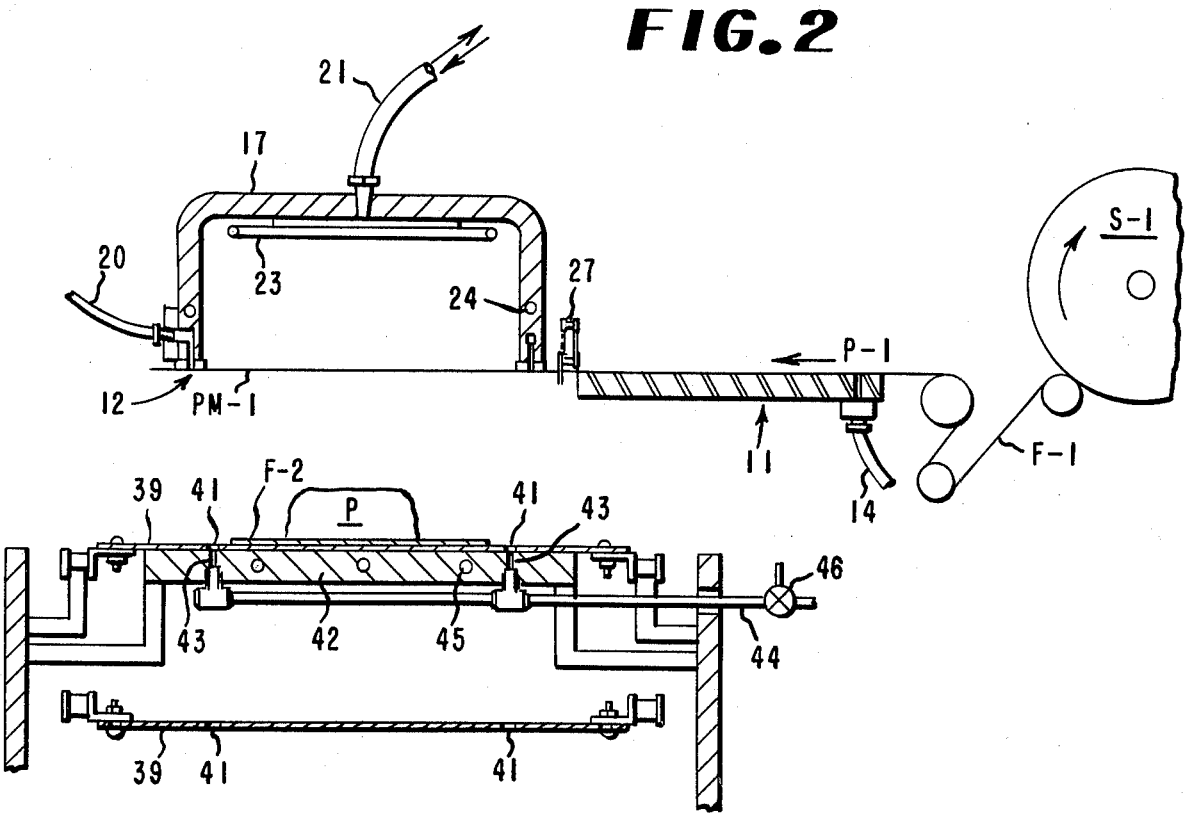
FIG. 2 is a sectional view of the apparatus of FIG. 1 taken along lines 2—2 thereof (with parts omitted for clarity).
Figure 3:
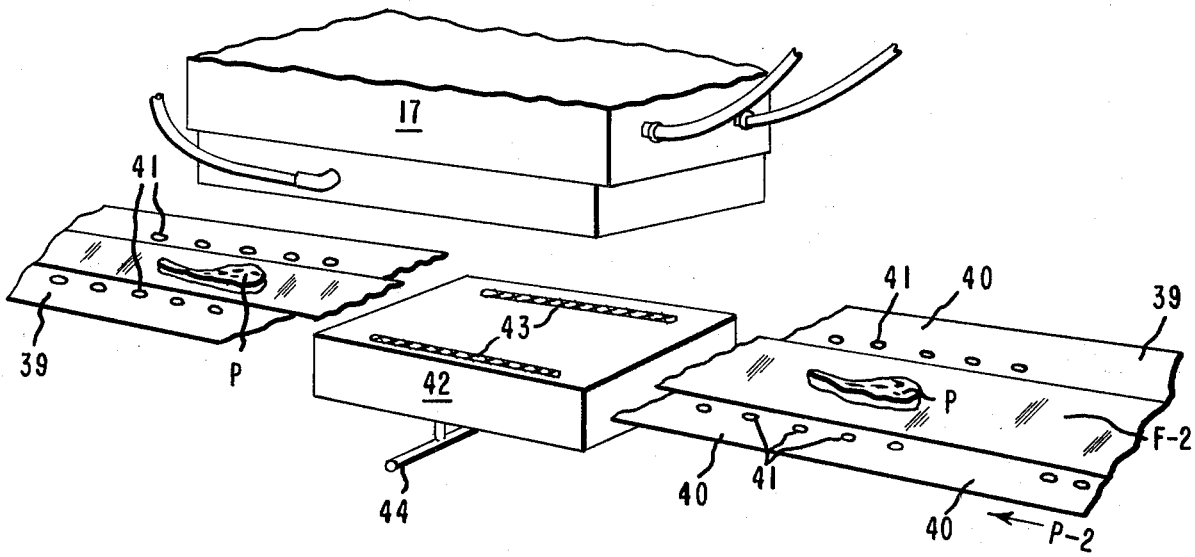
FIG. 3 is a perspective view showing, in greater detail, various parts of the apparatus of FIG. 1, including means for creating a vacuum at a package-forming station (including a movable vacuum chamber and a fixed vacuum plate), and further showing a lower film with a product to be packaged thereon positioned on a conveyor belt which is movable to and past the package-forming station.

Referring to the drawings, and FIGS. 1, 2 and 3 in particular, in starting to make such package an upper thermoplastic film F-1 is supplied from a supply source S-1 and moved along a first path P-1 by appropriate mechanical moving means to the package-forming station. The supply source may be any appropriate source, for example, it may be a roll of ionomer film.

At the package-forming station, the upper film F-1 is severed to form an upper package member PM-1, which, as formed, is in position ready to start the package-making operation. The movement of the upper film F-1 to this station and the forming there of the package member PM-1 are first key steps in the making of the package and further represent improvements in the art of material handling.

Figure 11:
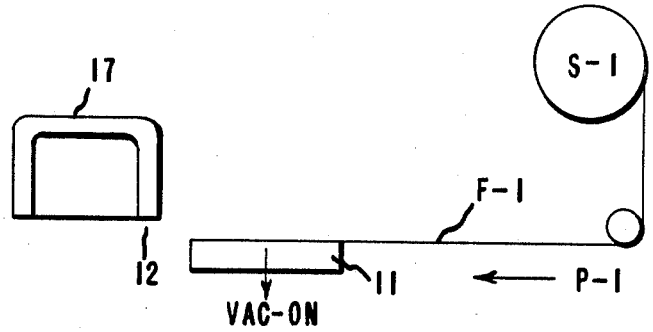
FIGS. 11–16 show, schematically, the operation of various parts of the apparatus of this invention, primarily the upper film first holding means and second holding means (the movable vacuum chamber), and fixed vacuum plate, in forming a vacuum skin-package in accordance with this invention.
Figure 12:
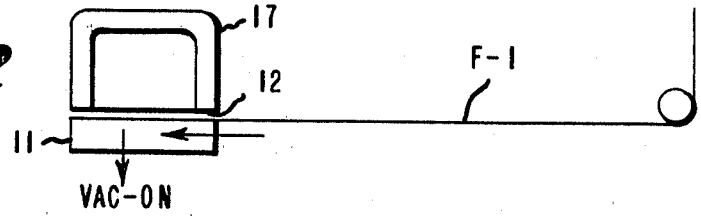
Figure 13:
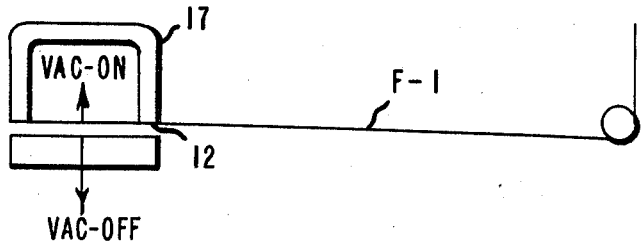
Figure 14:
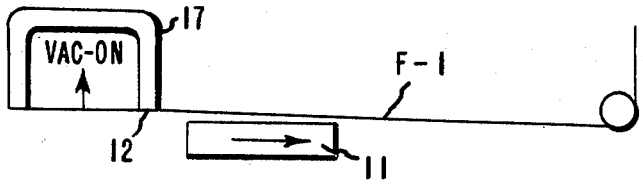
Figure 15:
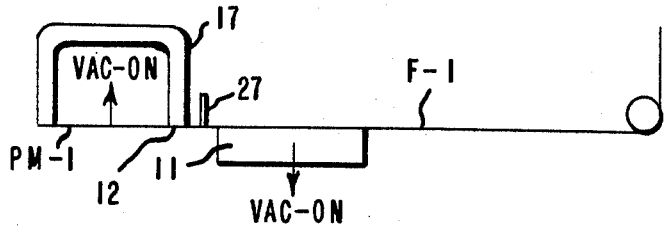
Figure 16:
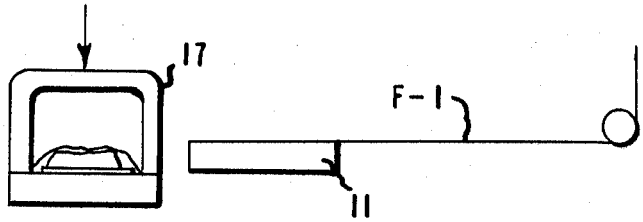

These steps in starting the making of a vacuum skin-package in accordance with this invention, accordingly, include the material handling method steps of:

engaging a portion of a film, such as upper film F-1, supplied from supply source S-1 with a first holding means 11 located in a first position in the path P-1 of the film (as seen in FIG. 11);

moving the first holding means 11 and engaged film F-1 to a second position located adjacent to a second holding means 12 (as seen in FIG. 12);

transferring the film F-1 from the first holding means 11 to the second holding means 12 at such second position (as seen in FIG. 13);

returning the first holding means 11 to its first position while the film F-1 is held in the second position by the second holding means 12 (as seen in FIG. 14);

engaging another portion of the film F-1 at the first position by the first holding means 11 (as seen in FIG. 15); and severing the film F-1 in a transverse path between the first and second positions to form a package member PM-1 while the film is held on either side of the transverse severance path by the first and second holding means 11 and 12 (again as seen in FIG. 15).

In the preferred embodiment of this invention being described, the second holding means 11 is a part of a movable vacuum chamber, further to be described, which holds the upper package member PM-1 in its starting position, in making a package, at the package-forming station.

In the making of the package at this station the material handling method of this invention includes the further steps of:

moving the second holding means 12 and held package member PM-1 to a third position in a path perpendicular to the plane of the path P-1 of the film as a step in the package-making method.

By following these basic material handling steps, it is possible readily to bring the upper package member PM-1 into its proper position at the package-forming station, ready to start the package-making operation, using a minimum of parts and motions. It, then, is only necessary to bring the lower film and product to be packaged to this station, as later will be described, to complete the preliminary prepackage-forming positioning steps, prior to the package-making operation.

UPPER FILM HOLDING MEANS

As best seen in FIGS. 2, 4 and 11–15, the upper film F-1 used to make the vacuum skin-package in accordance with this invention is supplied from the upper film supply roll S-1 and is moved to the package-forming station by use of the first (upper film) holding means 11 which operates in the path P-1 of the upper film supply (as best shown by the direction arrow in FIG. 2).

Figure 4:
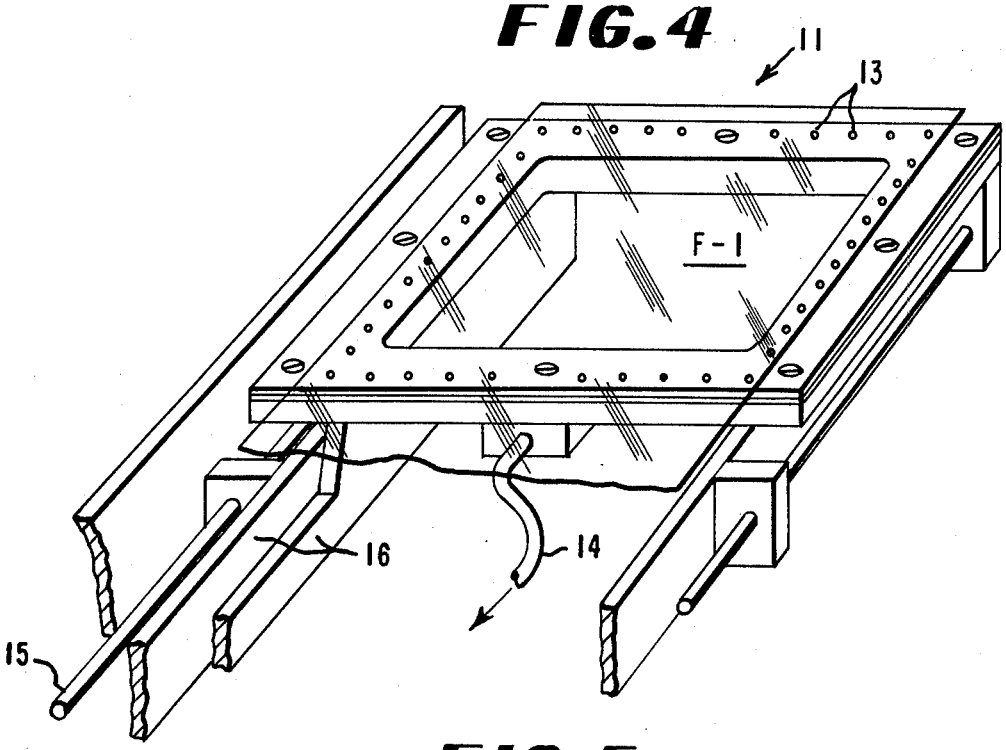
FIG. 4 shows an upper film holding means (and associated parts) with the upper film engaged thereby, such holding means being adapted to be moved into a package-forming starting position at the package-forming station.

FIG. 4 shows the first holding means 11 in greater detail. The upper film F-1 is held against the upper surface of the first holding means 11 during dwell and film moving sequences by use of vacuum holes 13 positioned around the upper peripheral surface thereof, which holes are connected to a vacuum system 14. The leading edge of the upper film F-1 is shown adjacent to the leading edge of the first holding means 11 in this figure.

This holding means 11 and its captive piece of upper film F-1 is moved, by appropriate means, under the lower surface of the second holding means 12, as guided by outer guides 15 and inner guides 16. The leading edge of the first holding means 11 is lowered and raised by a cam mechanism attached to these guides (not shown in FIG. 4) during this movement. As thus moved, the film is positioned adjacent a movable vacuum chamber 17, of which the second holding means 12 is a part, and the upper film F-1 is transferred from the first holding means 11 into engagement with the second holding means 12 of such vacuum chamber 17 at the package-forming station.

In summary, at this stage of making the package, the positioning of the upper film in this embodiment includes the steps of:

engaging the upper film F-1 with a first holding means 11;

moving the engaged upper film F-1 to a position adjacent the vacuum chamber 17; and transferring the upper film F-1 from the first holding means 11 into engagement with the vacuum chamber 17 at the package-forming station.

Further, also in summary, a material handling apparatus for so positioning the upper film includes:

the first holding means 11 for engaging a portion of a film in the first position in the path P-1 of the film F-1;

means for moving the first holding means 11 and engaged film F-1 to second position located adjacent to the second holding means 12;

means for transferring the film F-1 from the first holding means 11 to the second holding means 12 at such second position;

means for returning the first holding means 11 to its first position while the film F-1 is held in the second position by the second holding means 12, such first holding means 11 being adapted to engage another portion of the film F-1 at such first position; and means, later to be described in detail, for severing the film in a transverse path between the first position and the second position to form a package member PM-1 while the film on either side of the transverse severance path is held by the first and second holding means 11 and 12.

In other embodiments of this invention, the upper film (or an upper package member) may be brought into engagement with the second holding means 12 of the vacuum chamber 17 manually, or by other appropriate means.

MOVABLE VACUUM CHAMBER

Figure 5:
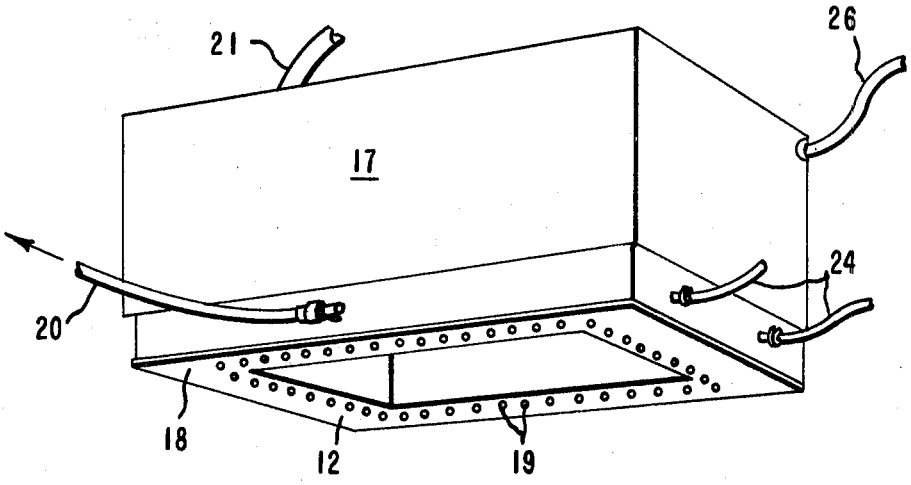
FIG. 5 shows another upper film holding means, in the form of the movable vacuum chamber as shown in FIG. 3, in a perspective showing.

FIG. 5 shows the movable vacuum chamber 17 in greater detail.

As previously explained, the second holding means 12 is located at the mouth of this vacuum chamber 17, at a resilient lower surface 18 thereof, which surface is adapted to form a fluid-tight seal when operatively engaged with a fixed plate, later to be described, as best seen in FIGS. 9 and 10, in key stages in the package-making operation. Such holding means 12 is controlled by an upper film holding vacuum means which controls the transfer of the upper film F-1 and holds it in place while it is severed, heated, and draped over the product in later package-making stages.

In further detail, such chamber 17 includes means defining a plurality of holes 19 around its lower peripheral surface 18, which holes 19 communicate with a vacuum conduit means 20. The advanced upper film F-1 when in the starting position at the package-forming station preferably is held against this lower surface 18 of the vacuum chamber 17 by actuating these vacuum means. This surface 18 or mouth of the vacuum chamber 17, as stated, is resilient for later effecting a fluid-tight seal in a package-making stage or step.

The vacuum chamber 17 additionally is equipped with vacuum means, in the form of a vacuum conduit 21, for forming a vacuum in the space 22 in the chamber 17 above the upper package member PM-1 as held by the second holding means 12 (as best seen in FIGS. 9 and 10) and for venting this space 22; means, including a heater 23 positioned in the upper part of the chamber 17, for heating the upper film PM-1 to a formable condition; and means 24 for cooling such film and for keeping the second holding means 12 at a temperature low enough to prevent excessive heating of the upper film F-1 during the preliminary package-making operations. The chamber vacuum means is operable through a suitable three-way valve 25 and the upper film heater 23, as best shown in FIG. 8, is connected to a power source by suitable heater power leads.

After the upper film F-1 has been transferred to the second holding means 12 of the vacuum chamber 17, it is severed from the supply source to form the package member PM-1, as further will be described. This member PM-1 is then heated by the electric heater 23 as a last preliminary step prior to the package-making operation.

Appropriate means, not shown, are provided for moving this chamber 17 and the heated package member PM-1 held by the second holding means 12 from its starting position at the package-forming station, as shown in FIG. 8, downwardly, as a step in the package-forming operation, as further will be explained.

UPPER FILM SEVERING MEANS AND METHOD

In making a package according to this invention, a method of and means for severing the upper film F-1 is provided which further represents a means and method of severing film in other environments.

Figure 6:
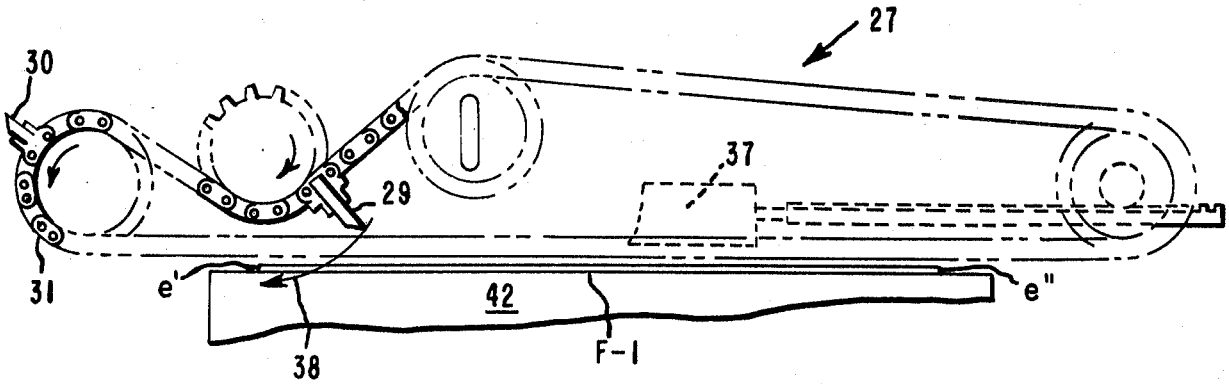

Broadly speaking, such film severing method includes the steps of:

engaging a portion of a film, such as upper film F-1, having first and second edges $e'$ and $e''$ with a first holding means, such as holding means 11;

engaging another portion of the film F-1 by a second holding means, such as holding means 12; and severing the film, for example, using a severing means 27, as shown in FIGS. 6 and 7, in a transverse path between the first and second holding means while the film F-1 is held on either side by such first and second holding means, such severing including cutting the film F-1 at the first edge $e'$ by moving a severing initiating means 29 into the film at a position spaced from the first edge $e'$ and thereafter in a first direction toward and through such first edge $e'$ to form a partial cut, and completing the severing of the film by moving a severing completing means 30 in a second direction into the partial cut and thereafter through the film F-1 toward and through the second edge $e''$ thereof whereby to sever the film F-1.

Preferably the film F-1 is held by vacuum means of the first and second holding means during severing.

And, as a preliminary operation, in the package-making method, in a preferred embodiment of this invention, such film-severing method includes the steps of:

engaging a portion of the film F-1 with the first holding means 11 located in a first position in a path P-1 of the film;

moving the first holding means 11 and engaged film F-1 to a second position located adjacent a second holding means 12;

transferring the film F-1 from the first holding means 11 to the second holding means 12 at such second position;

returning the first holding means 11 to its first position while the film F-1 is held in the second position by the second holding means 12;

engaging another portion of the film F-1 at the first position by the first holding means 11; and severing the film F-1 in a transverse path between the first and second positions while the film is held on either side of the transverse severance path by the first and second holding means 11 and 12, such severing including:

cutting the film F-1 near the first edge $e'$ by moving the severing initiating means 29 into the film at a position spaced from the first edge $e'$ and thereafter in a first direction toward and through such first edge to form a partial cut and completing the severing of the film by moving the severing completing means 30 in an opposing second direction into the partial cut and thereafter through the film toward and through the second edge $e''$ whereby to sever the film.

This severing step forms the package-member PM-1, which, as severed, is in its package-forming start-up position, as so held by the second holding means 12 of the movable vacuum chamber 17.

The severing means 27 preferred for use in accordance with this invention is shown in detail in FIGS. 6 and 7.

The first cutting performed by the severing means 27 is in the form of a first film-nicking step, followed by a continued severing step. These operations are respectively performed by the severing initiating means 29 (preferably in the form of a knife blade) and the severing completing means 30 (also preferably in the form of a knife blade), which blades are mounted on an endless roller chain 31. The endless chain 31 is driven by a driving sprocket 32 and is guided in its path by a take-up idler sprocket 33 and fixed idler sprockets 34. Pinion 35 is attached to driving sprocket 32 and is actuated by rack 36, by operation of an actuating rack cylinder 37.

FIG. 6 shows the severing means 27 in its dwell position prior to the film severing operation. At the start of the severing operation the first knife blade 29 moves into the upper film F-1 to produce a cut or nick that is started inside the edge $e'$ of the upper film F-1 and continues to and through the edge $e'$, as shown by direction arrow 38 in FIG. 6.

The severing completing means 30 then meets the upper film F-1 at the end of the severance path formed by the severing initiating means 29 and severs the remaining portion of the upper film F-1 in a transverse and opposite direction. This manner of severing eliminates the high cutting forces and associated film distortion encountered when the complete transverse cutting or severing is attempted with a single blade which is initiated against one edge of the film and then through it in a single direction.

FIG. 7 shows the severing means as it appears on the completion of the severing operation. The first knife blade 29 traverses the path across the film F-1 in an upright position situated above the film in an inverted configuration as shown in FIG. 7, while the second blade completes the severing of the film F-1 to form, in an embodiment of this invention, the package-member PM-1.

Continuing with the starting, prepositioning steps involved in the making of the package, as best seen in FIGS. 1 and 3, a lower thermoplastic film F-2 is supplied from a supply source, such as supply roll S-2, and moved in a second path P-2 to the package-forming station. This phase of the method of making such package includes the predetermined positioning of the lower film F-2 on the conveyor belt 39. This belt 39 has means defining opposed sets 40 of apertures 41 spaced from each along the edges of the belt, as best seen in FIG. 3, and the lower film F-2 is positioned between and spaced from these opposed sets of apertures 41, so that they may remain open.

A product P to be packaged is then placed on the lower film F-2 between opposed sets 40 of apertures in such belt 39. The belt 39 having the lower film F-2 and the product P so positioned thereon is moved to the package-forming station, by appropriate means, and above a fixed vacuum plate 42 further to be described and in operative relationship therewith. In this position, the lower film F-2 and the product P are in their starting positions, ready for the package-forming steps to begin.

FIXED VACUUM PLATE

FIG. 3 shows, in greater detail, the fixed vacuum plate 42 that is used in conjunction with the movable vacuum chamber 17 to produce the vacuum enclosure that makes possible the making of a package by the method of this invention. The plate 42 contains openings 43 at its edges covered with fine mesh screens that communicate with a vacuum pumping system 44 to remove air through such openings.

The cut-away view of the belt 39, as seen in FIG. 2, for example, shows the spaced apertures 41 in such belt that permit passage of air through the belt 39. As shown, the opposed openings 43 along the edges of the plate 42 are aligned with opposed apertures 41 in the belt 39 at the package-forming station. Air is drawn through these apertures 41 and openings 43 to form a vacuum around the product, when forming the package.

The plate 42 further is provided with means for heating the lower film, in the form of heating elements 45, such as cartridge heaters, whereby the lower film F-2 will be rendered heat-sealable to the upper film F-1 in making the package.

In greater detail the fixed vacuum plate 42 preferably is machined from a solid metal block and contains a temperature sensor. The openings 43 in the plate 42 preferably are covered by the screens or sintered metal. The entire block or plate may be heated.

In other preferred aspects of this invention, the upper film supply roll S-1 is positioned at a right angle relative to the lower film supply roll S-2; accordingly, the film paths P-1 and P-2 are at right angles to each other in the movement of the respective films to the package-forming station.

Upon completion of the package-making operation, as will now be described in detail, the conveyor belt 39 continues its movement, to the left as shown in FIG. 3, for example, carrying with it the lower film F-2, the product P, and the upper package member PM-1, which is in skin-like contact with the product P and heat-sealed to the lower film F-2.

Preferably, from the package-making station these parts are next moved to a cooling station, as best shown in FIG. 1, to aid in the separation of the lower film F-2 from the conveyor belt 39. From this station, after separation, the parts are moved to a final station consisting, for example, of a guillotine cut-off knife which cuts such lower film F-2 and completes the formation of an individual vacuum skin-package.

In other embodiments of this invention, the upper film F-2 may be moved to the package-forming station by tenter clips, such as are used in a typical tenter frame. These clips preferably are spaced in sets on continuous chains and perform similar functions to the first holding means 12 in the preliminary steps of the package-forming operation. Preferably, the belt 39 is of Kapton® polyimide film.

® Trademark of E. I. du Pont de Nemours and Company

After the upper film package PM-1, the product P and the lower film or package member PM-2 are in their operative positions at the package-making station, as shown in FIG. 8, the package-making operation may begin.

METHOD OF MAKING THE PACKAGE

Broadly described, a method of making a vacuum skin-package according to this invention includes the steps of:

- positioning the lower film F-2 on the conveyor belt 39, such belt 39 having means defining opposed sets 40 of apertures spaced from each other along the edges of the belt and the lower film F-2 being positioned between the opposed sets 40 of apertures in the belt 39;
- placing the product P to be packaged on the lower film F-2 between opposed sets 40 of apertures in the belt;
- moving the belt having the lower film F-2 and the product P thereon to the package-forming station above the fixed vacuum plate 42 having means defining opposed openings 43 along the edges thereof, such openings 43 being aligned with opposed sets 40 of apertures 41 in the conveyor belt 39 at the package-forming station,
- engaging the upper package member PM-1 with the vacuum chamber 17 at the package-forming station;
- heating the upper package member PM-1;
- moving the vacuum chamber 17 and the heated upper package member PM-1 downwardly so as to drape this member around the product and to form a hermetic seal between the vacuum chamber 17, the conveyor belt 39, the lower film F-2, upper package member PM-1 and the vacuum plate 42 and to enclose therewithin the opposed sets 40 of apertures 41 in the conveyor belt that are aligned with the opposed openings 43 in the vacuum plate 42 (as shown in FIG. 9);

evacuating the space above the upper package member PM-1 and also around the product P, the latter occurring through such aligned apertures 41 in the conveyor belt 39 and openings 43 in the vacuum plate 42 while maintaining the hermetic seal (as shown in FIG. 9); and pushing the upper package member PM-1 by pressure differential into skin-tight conformity with the product P and into heat-sealing contact with the lower film F-2 (as shown in FIG. 10) to form a vacuum skin-package.

Such method also may include:

engaging the upper film F-1 with the first holding means 11;

moving the engaged upper film F-1 to a position adjacent the vacuum chamber 17; and transferring the upper film F-1 from the first holding means 11 into engagement with the vacuum chamber 17 at the package-forming station.

Preferably, in this method, the conveyor belt 39 with the lower film F-2 and the product P thereon is moved in a first direction to the package-forming station, and the upper film F-1 is moved in a second direction transverse to the first direction to the package-forming station. And, lastly, the vacuum chamber 17 and heated upper film F-1 are moved downwardly in a third direction or path P-3 perpendicular to the plane of the first and second direction paths P-1 and P-2 to the package-forming station so as to drape such upper film F-1 around the product P and to form the hermetic seal between the vacuum chamber, the conveyor belt, the lower film, the upper package member and the vacuum plate and to enclose therewithin the opposed sets of apertures 41 in the conveyor belt 39 that are aligned with the opposed openings 43 in the vacuum plate 42.

A method and apparatus of this invention for making a vacuum skin-package is shown in FIGS. 8, 9 and 10.

In FIG. 8, lower film F-2 and the conveyor belt 39 are shown in a sectional view transverse to the run of the conveyor belt 39 while the upper package member PM-1 is shown in a sectional view taken along the run of the upper film F-1 which is normal to the direction of the conveyor belt 39. The upper film F-1 has been supplied from the upper film supply roll S-2 as has been described in detail. The upper package member PM-1, as shown, is maintained in position at the mouth of the vacuum chamber 17 by means of the second holding means 12 which is a part of the vacuum chamber 17 and is connected to the upper vacuum system 20 via the vacuum holding ring. The chamber vacuum system 21 is not in its operative state in FIG. 8 since the three-way valve controlling it is in the vented position. The heater 23 is energized to warm the upper package member PM-1 sufficiently to enable it to be drawable.

The lower film F-2 shown in FIG. 8 is positioned on the conveyor belt 39 between the conveyor belt apertures 41 while the product P is positioned on the lower film F-2. The plate heaters 45 provide sufficient heat through the conveyor belt 39 to keep the upper surface of lower film F-2 in a condition for rapid bonding to the heated upper package member PM-1.

FIG. 9 shows the package-forming operation when the vacuum chamber 17 has been closed to form a hermetic seal with the fixed plate 42 while portions of the conveyor belt 39, upper package member PM-1 and lower film F-2 are contained within the sealing area bounded by the fixed plate 42 and the resilient lower surface of the vacuum chamber 17. In this sealing position air is removed from above the upper package member PM-1 via the chamber vacuum system 21 and its upper three-way valve and is removed below the upper member PM-1 and from around the product P via the lower vacuum system 44 and its lower three-way valve. Thus, the lower film F-2 and product P are situated in a vacuum under complete cover of the upper package member PM-1.

The final stage of the vacuum skin-packaging operation is shown in FIG. 10. Vacuum beneath the upper package member PM-1 is maintained through the lower vacuum system 44 while the space in the vacuum chamber 17 above the upper package member PM-1 is vented to the atmosphere via the chamber vacuum system 21 and its three-way valve. The differential pressure resulting across the heated upper package member PM-1 forces it down around the product P into skin-tight conformity and into heat-sealing contact with the lower film F-2 around the confines of the product P to produce the skin-tight vacuum package shown in a cross-sectional view in FIG. 10. This, in essence, completes the making of the package.

What is claimed is:

1. Apparatus for making a vacuum skin-package including:

a conveyor belt having means defining opposed sets of apertures spaced from each other along the edges of the belt;

a fixed vacuum plate having means defining openings along the edges thereof;

means for moving the belt having a flat lower film and product positioned thereon between such opposed sets of apertures to a package-forming station above the fixed vacuum plate, and the openings in the vacuum plate being connected to a vacuum source;

means for engaging an upper film with a vacuum chamber at the package-forming station;

means for heating the upper and lower films;

means for moving the vacuum chamber and the heated upper film downwardly so as to drape the upper film around the product and to form a hermetic seal between the vacuum chamber, the conveyor belt, the lower and upper films and the vacuum plate and to enclose therewithin opposed sets of apertures in the conveyor belt and opposed openings in the vacuum plate;

means for evacuating the space above the upper film after such hermetic seal is formed;

means for evacuating the space around the product through such opposed sets of apertures in the conveyor belt and opposed openings in the vacuum plate enclosed within such hermetic seal while maintaining the hermetic seal between the vacuum chamber, the upper and lower films, the conveyor belt and the vacuum plate; and, means for pushing the upper film by pressure differential into skin-tight conformity with the product and into heat-sealing contact with the lower film to form a vacuum skin-package.

2. The apparatus of claim 1 further including:

means for engaging the upper film with a holding means;

means for moving the engaged upper film to a position adjacent the vacuum chamber; and means for transferring the upper film from the holding means into engagement with the vacuum chamber at the package-forming station.

* * * * *